United States Patent [19]

Wojtowicz

[11] 3,997,808

[45] Dec. 14, 1976

[54] MOUNTING FOR SINGLE-ENDED LAMP

[75] Inventor: Joe J. Wojtowicz, Cleveland Heights, Ohio

[73] Assignee: General Electric Company, Schenectady, N.Y.

[22] Filed: June 30, 1975

[21] Appl. No.: 591,491

[52] U.S. Cl. ..... 313/113; 240/41 BM; 240/41 SB; 313/315; 313/318; 339/145 R

[51] Int. Cl.[2] ..... F21M 3/00; H01K 1/46

[58] Field of Search ..... 313/113, 115, 222, 315, 313/316, 318; 240/41 BM, 41 SB; 339/144 R, 144 T, 145 R, 145 T

[56] References Cited

UNITED STATES PATENTS

| | | | |
|---|---|---|---|
| 2,033,699 | 3/1936 | Frech | 240/41 BM |
| 2,132,368 | 10/1938 | Geiger | 313/315 |
| 3,516,042 | 6/1970 | Wagner | 339/45 |
| 3,885,149 | 5/1975 | Wolfe et al. | 240/41 BM |

*Primary Examiner*—Siegfried H. Grimm
*Attorney, Agent, or Firm*—Paul F. Wille; Lawrence R. Kempton; Frank L. Neuhauser

[57] ABSTRACT

A miniature wire lamp is cemented into a ceramic holder such that the filament is precisely located with respect to the holder.

15 Claims, 4 Drawing Figures

MOUNTING FOR SINGLE-ENDED LAMP

BACKGROUND OF THE INVENTION

This invention relates to a holder for precise location of the filament of wire lamps, in particular, to a holder for halogen cycle lamps, and to single-ended inner lamps mounted in a reflector.

Now, as in the past, reflector lamps, such as sealed beam automotive lamps, require careful construction to ensure precise alignment of the filament with the optics of the reflector. Recently, the use of sealed inner lamps and, particularly, single-ended halogen cycle lamps has complicated the manufacture of sealed beam lamps since more manufacturing steps have been added which affect the alignment of the filament with the reflector optics. For example, the use of allglass, wire, baseless, or wedge-base lamps (herein referred to as "inner lamps") requires both the precise alignment of the filament within the envelope and the alignment of the envelope with the reflector.

Further, the mass of the inner lamp must be adequately supported with respect to the reflector so that the initial alignment is not lost through vibration and shock. However, the support of the lamp cannot be considered independently of other factors affecting the manufacture of the inner lamps. For example, adequate support requires that large lead wires be used which will be sufficiently rigid to hold the lamp in place. However, the use of large lead wires makes sealing the inner lamp difficult, due to the size of the wire and its coefficient of thermal expansion.

SUMMARY OF THE INVENTION

In view of the foregoing, it is therefore an object of the present invention to provide a new holder for precisely mounting inner lamps.

Another object of the present invention is to provide a new mounting system for attaching single-ended lamps to a sealed beam reflector.

A further object of the present invention is to provide a new mounting system which eases production restrictions on inner lamps used in a sealed beam reflector.

It is another object of the present invention to provide a rugged mounting system for lamps within a sealed bean envelope.

It is a further object of the present invention to provide an improved sealed beam lamp.

The foregoing objects are achieved in the present invention wherein a ceramic holder is provided in which one or more of the outer surfaces of the holder provide reference points for mounting the inner lamp in a reflector. A lamp is mounted in the holder using a suitable adhesive, e.g., basing cement. The inner lamp is aligned in the holder with respect to its filament, enabling one to use most inner lamps produced that have filaments which are not precisely aligned with the envelope, thereby increasing the yield of inner lamps. Manufacture is simplified since the lead wires need only match the current requirements of the inner lamp and adequately match the coefficient of thermal expansion of the glass. An improved sealed beam lamp results, in one embodiment, since higher efficiency halogen cycle lamps can now be utilized, and, in another embodiment, since construction is simplified by using the holder as a filament shield.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
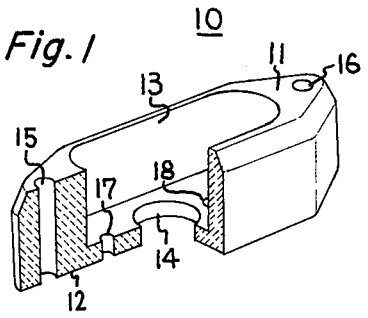
FIG. 1 illustrates a preferred embodiment of a holder in accordance with the present invention.

Referring to FIG. 1, holder 10 is illustrated as having an elongated hexagonal shape defined in part by surfaces 11 and 12, which in use form reference surfaces, preferably parallel, from which the filament of the inner lamp is positioned. Holder 10 further comprises a hollow central portion 13 into which the inner lamp is positioned. Hollow central portion 13 does not extend through holder 10, but is provided with a relief aperture 14 through which excess cement or other binding material can flow during the assembly of the inner lamp with holder 10. At each end of holder 10, there is provided a bore 15 or 16, preferably orthogonal to the reference surfaces, to which the supporting leads of the finished lamp are attached. In addition, bores 17 and 18 are provided in central portion 13 through which the conductive leads from the inner lamp may be inserted. Depending upon the size of bores 17 and 18, aperture 14 can be eliminated. However, it is preferred that aperture 14 be retained so that there is adequate flow of excess binding material.

While illustrated as a geometric solid having an elongated hexagonal shape, holder 10 may have any suitable shape provided that at least one of reference surfaces 11 and 12 is relatively flat to enable ease of alignment of the filament of the inner lamp with one of these reference surfaces. Similarly, while holder 10 is illustrated in FIG. 1 as comprising a ceramic material, any suitable material can be utilized as long as it is relatively rigid and can withstand the elevated operating temperatures of the inner lamp, particularly halogen cycle inner lamps.

Figure 2:
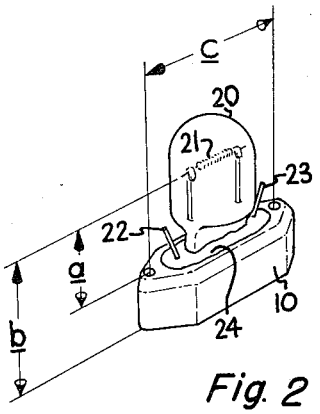
FIG. 2 illustrates a holder and lamp combined and some reference dimensions.

FIG. 2 illustrates a mounted inner lamp ready for assembly into a sealed beam reflector. Specifically, inner lamp 20 has the base thereof positioned within the central aperture of holder 10 and the remainder of the volume filled with a suitable adhesive 24, such as basing cement. Lamp basing cement is well known per se in the art and is available, for example, from Sauereisen Corporation.

The manufacture of mounted inner lamps is accomplished by prefilling holder 10 with a measured or predetermined amount of basing cement, and inserting inner lamp 20 while holder 10 is maintained in a reference position by a suitable fixture or jig. After inner lamp 20 is inserted in holder 10, the alignment of filament 21 is adjusted relative to either surface 11 or 12 by suitable optical means, known in the art, and the basing cement is cured. For example, where heat curing basing cement is utilized, after filament 21 is aligned, the cement can be cured by gas fires, infrared lamps, or by activating filament 21 to produce the heat for curing adhesive 24.

As illustrated in FIG. 2, leads 22 and 23 of inner lamp 20 protrude upwardly from holder 10. Depending upon the positioning of inner lamp 20 within the sealed beam reflector, leads 22 and 23 are brushed upwardly around the inner lamp 20 prior to insertion into holder 10, or are straightened and positioned for insertion through bores 17 and 18 to extend downwardly from holder 10. Since leads 22 and 23 provide no supportive function, a process step in the manufacture of inner lamp 20 is eliminated since additional, heavier conductors need not be welded or joined to the leads from inner lamp 20. Leads 22 and 23 may comprise molybdenum or dumet or any other lead utilized for inner lamp 20 which provides adequate current-carrying capability and approximately matches the coefficient of thermal expansion of the envelope of inner lamp 20.

As previously indicated, holder 10 may comprise any suitable shape. There are, however, some dimensional restrictions on the finally assembled mount as illustrated in FIG. 2. For example, in order to precisely position filament 21 within the sealed beam reflector, the distance from filament 21 to either the upper or lower surface of holder 10, designated *a* or *b*, respectively, must be carefully controlled during the assembly of inner lamp 20 and holder 10. Similarly, since the supporting leads from the sealed beam lamp will be attached to bores 15 and 16, the spacing, *c*, between bores 15 and 16 must also be maintained accurately during the manufacture of holder 10.

Figure 3:
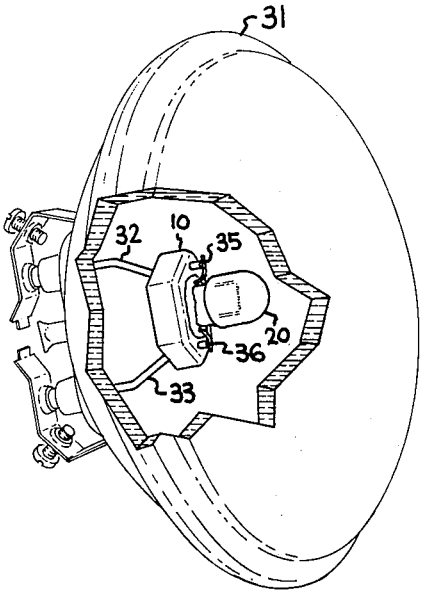
FIG. 3 illustrates one embodiment of a sealed beam lamp in accordance with the present invention.

FIG. 3 illustrates one embodiment of a completed sealed beam lamp in which holder 10 is positioned between the filament and the reflective surface of the sealed beam lamp. In this embodiment, lamp 31 has heavy conductive supports 32 and 33 projecting inwardly and passing through bores 15 and 16 of holder 10. The leads of inner lamp 20 are soldered, welded or otherwise suitably electrically connected to the ends of supporting conductors 32 and 33 at points 35 and 36, respectively. The positioning of holder 10, and consequently filament 21, is controlled by the bends in supporting leads 32 and 33. Other suitable means for supplying a mechanical reference to one of surfaces 11 and 12 can be employed. For example, if leads 32 and 33 were parallel, then a crimp or other deformation at the appropriate point could be provided. The result is that filament 21 of inner lamp 20 is accurately positioned within sealed beam 31.

Since it has been accurately positioned with respect to one of reference surfaces 11 or 12, the filament of inner lamp 20 need not be as carefully positioned with respect to the envelope of inner lamp 20 as has been required of inner lamps of the prior arts since the base of the lamp is not being used as the reference point for positioning the lamp in sealed beam reflector 31. Also, the manufacture of the sealed beam lamp is simplified since the leads of the inner lamp are not being used for support.

Figure 4:
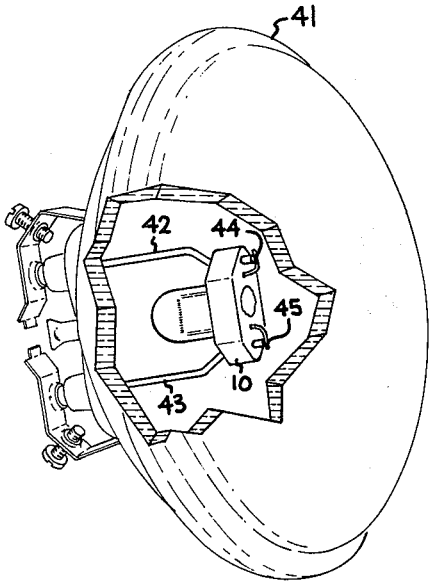
FIG. 4 illustrates another embodiment of a sealed beam lamp in accordance with the present invention.

FIG. 4 illustrates another embodiment of the present invention in which filament 21 is positioned between holder 10 and the reflective surface of sealed lamp 41. In this embodiment, the wire leads from inner lamp 20 project through bores 17 and 18 and are attached at the ends 44 and 45 of conductive supporting leads 42 and 43, respectively. In this embodiment, filament 21 can be positioned closer to the reflective surface of sealed beam lamp 41 and is particularly useful in small sealed beam lamps or in lamps where the forcus is close to the reflecting surface. In addition, it enables one to utilize a larger inner lamp within sealed beam lamp 41. An additional advantage of the construction of lamp 41 is that holder 10 acts as a filament shield, thereby providing better control of the light pattern produced by lamp 41 since the beam is obtained from the reflective surface rather than, in part, directly from filament 21. Thus, FIG. 4 is useful, for example, as a "low beam" lamp, whereas the embodiment of FIG. 3 is suitable as a "high beam" lamp.

There is thus provided by the present invention a new holder for use in mounting inner lamps within sealed beam reflectors. The holder enables one to obtain a rigid mounting without complicating the manufacture of the inner lamp. Further, the holder of the present invention enables one to use a greater fraction of the inner lamps produced, since the filament of the inner lamp need not be precisely aligned with the envelope. By virtue of the holder of the present invention, one can sturdily mount inner lamps within sealed beam reflectors and obtain the additional advantage of the elimination of filament shields.

Having thus described the invention, it will be apparent to those of skill in the art that various modifications can be made within the spirit and scope of the present invention. For example, depending upon the application of the lamp, the filament could be mounted within the reflector such that the axis of the filament is parallel to the optical axis of the reflector. Also, one could add additional supports to the mounted inner lamp attached, for example, through bores 17 and 18 in lamp 31, if the lamp were to be subjected to extraordinary shock and vibration. Further, while sealed beam headlamps are presently required in the United States, a sealed reflector is not required for use in the present invention. Also, while a single filament inner lamp is illustrated, dual filament inner lamps can also be used.

What I claim as new and desire to secure by Letters Patent of the United States is:

1. A holder for single-ended inner lamps comprising:
   - a geometric solid of electrically insulating material bounded by at least one plane, said plane being a reference surface;
   - a central hollow portion defined by said solid, extending away from said reference surface, and adapted to receive the end of a single-ended lamp;
   - first and second bores through said solid and intersecting said reference plane, said first and second bores positioned on opposite sides of said hollow portion; and
   - a relief aperture in said solid, said aperture merging with said hollow portion to form an opening extending through said solid.

2. The holder as set forth in claim 1 wherein said geometric solid is bounded by two, spaced, parallel planes, each of said planes being a reference surface, wherein said hollow portions intersects one of said reference surfaces.

3. The holder as set forth in claim 2 wherein said holder further comprises:
   - at least one bore in said solid interconnecting said hollow portion and the other of said reference surfaces.

4. The holder as set forth in claim 3 wherein said holder comprises a ceramic material.

5. The holder as set forth in claim 4 wherein the axes of said bores are parallel and orthogonal to one of said reference surfaces.

6. A lamp mount for use in an enclosed reflector comprising:

an incandescent inner lamp having conductive leads extending from the base thereof;

a holder comprising a geometric solid of electrically insulating material bounded in part by two parallel planes forming first and second reference surfaces, said hollow having hollow central portion, intersecting said first reference surface, adapted to receive the base of said inner lamp, and first and second bores on opposite sides of said hollow portion;

said inner lamp having the base thereof positioned in said hollow portion so that the filament of said inner lamp is spaced a predetermined distance from at least one of said reference surfaces; and a mass of adhesive in said hollow portion for attaching said inner lamp to said holder.

7. The lamp mount as set forth in claim 6 wherein said conductive leads extend outwardly from said first reference surface.

8. The lamp mount as set forth in claim 6 and further comprising:

third and fourth bores interconnecting said hollow central portion and said second reference surface; and wherein said conductive leads extend through said third and fourth bores and outwardly from said second reference surface.

9. In a beam projector lamp having a concave glass reflector section and a light-transmitting glass cover section, said reflector section having at least two lead wire openings adjacent the apex thereof, and at least two conductive supports passing through and sealed to said openings, the improvement comprising:

an incandescent inner lamp having conductive leads extending from the base thereof;

a holder comprising a geometric solid of electrically insulating material bounded in part by two parallel planes forming first and second reference surfaces, said holder having a hollow central portion, intersecting said first reference surface, adapted to receive the base of said inner lamp, and first and second bores on opposite sides of said hollow portion;

said inner lamp having the base thereof positioned in said hollow portion so that the filament of said inner lamp is spaced a predetermined distance from at least one of said reference surfaces;

a mass of adhesive in said hollow portion for attaching said inner lamp to said holder;

said conductive supports each having a deformation at a predetermined location along the length thereof and passing through said first and second bores to locate said filament at a predetermined position relative to said reflector section.

10. The beam projector lamp as set forth in claim 9 wherein said holder is located between said reflector section and said filament and said deformation contacts said second reference surface.

11. The beam projector lamp as set forth in claim 10 wherein said conductive leads extend outwardly from said first reference surface and are electrically connected one each to said conductive supports.

12. The beam projector lamp as set forth in claim 11 wherein said deformation comprises a bend in said conductive support.

13. The beam projector lamp as set forth in claim 9 wherein said holder is positioned between said cover section and said filament and said deformation contacts said first reference surface.

14. The beam projector lamp as set forth in claim 13 wherein said holder further comprises:

third and fourth bores interconnecting said hollow central portion and said second reference surface;

said conductive leads extend through said third and fourth bores and outwardly from said second reference surface, said conductive leads being electrically connected one each to said conductive supports.

15. The beam projector lamp as set forth in claim 14 wherein said deformation comprises a bend in said conductive support.

* * * * *